US009198819B2

(12) United States Patent
Reynolds

(10) Patent No.: US 9,198,819 B2
(45) Date of Patent: Dec. 1, 2015

(54) CREMATION URN WITH DECORATIVE APPLIQUE APPLIED THERETO

(71) Applicant: Batesville Services, Inc., Batesville, IN (US)

(72) Inventor: Kristine Ann Reynolds, Oldenburg, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 13/799,919

(22) Filed: Mar. 13, 2013

(65) Prior Publication Data

US 2014/0047684 A1 Feb. 20, 2014

Related U.S. Application Data

(60) Provisional application No. 61/683,525, filed on Aug. 15, 2012.

(51) Int. Cl.
*A61G 17/08* (2006.01)
*A61G 17/007* (2006.01)

(52) U.S. Cl.
CPC ..... *A61G 17/08* (2013.01); *A61G 17/0076* (2013.01)

(58) Field of Classification Search
CPC ..... A61G 17/08; A61G 17/0076; A44C 17/0208; A44C 15/003
USPC ..... 27/1; 63/1.14, 26; D99/5
See application file for complete search history.

(56) References Cited

U.S. PATENT DOCUMENTS

| | | | | | |
|---|---|---|---|---|---|
| 2,235,617 | A | * | 3/1941 | Klinzing | 220/288 |
| 2,385,520 | A | * | 9/1945 | Klinzing | 27/1 |
| 2,562,726 | A | | 7/1951 | MacDonald et al. | |
| 5,029,373 | A | * | 7/1991 | Raymond | 27/1 |
| D345,848 | S | | 4/1994 | May et al. | |
| 5,379,499 | A | * | 1/1995 | Jackson | 27/1 |
| D356,422 | S | | 3/1995 | Parker | |
| D360,732 | S | | 7/1995 | Parker | |
| D385,081 | S | | 10/1997 | Parker | |
| 5,815,897 | A | * | 10/1998 | Longstreth | 27/1 |
| D425,283 | S | | 5/2000 | Thesken | |
| D434,201 | S | | 11/2000 | Thesken | |

(Continued)

FOREIGN PATENT DOCUMENTS

| | | |
|---|---|---|
| CN | 201719497 | 1/2011 |
| CN | 201832093 | 5/2011 |

(Continued)

OTHER PUBLICATIONS

U.S. Appl. No. 61/675,628, filed Jul. 25, 2012.

(Continued)

*Primary Examiner* — William Miller
(74) *Attorney, Agent, or Firm* — Wood, Herron & Evans, LLP

(57) ABSTRACT

A cremation urn comprises a container that has a lower end and an upper end, and that is sized and configured to receive therein cremation remains of a deceased. An access cover is removably secured on the lower end of the container providing access to an interior of the container. A receptacle is located on the upper end of the container and has a bottom wall and an upstanding side wall extending peripherally around the bottom wall. An appliqué is secured in the receptacle.

23 Claims, 2 Drawing Sheets

(56) References Cited

U.S. PATENT DOCUMENTS

| | | | | |
|---|---|---|---|---|
| 6,526,636 | B2 * | 3/2003 | Bernhardt | 27/1 |
| 6,584,658 | B2 * | 7/2003 | Robinson | 27/1 |
| 6,735,831 | B1 | 5/2004 | Greiwe et al. | |
| 6,755,314 | B2 * | 6/2004 | Cooper | 215/386 |
| 7,000,760 | B2 * | 2/2006 | Lau | 206/6.1 |
| 7,318,262 | B1 * | 1/2008 | Florea et al. | 27/19 |
| D584,475 | S * | 1/2009 | Mytych et al. | D99/5 |
| D621,124 | S * | 8/2010 | Biegel | D99/5 |
| 8,046,881 | B2 * | 11/2011 | Johnson et al. | 27/1 |
| D650,964 | S * | 12/2011 | Roberson | D99/5 |
| 8,220,119 | B2 * | 7/2012 | Burlage et al. | 27/14 |
| 8,387,219 | B2 * | 3/2013 | Rojdev | 27/10 |
| 8,510,921 | B2 * | 8/2013 | Florea | 27/19 |
| 8,555,471 | B2 * | 10/2013 | Rojdev | 27/14 |
| 8,567,023 | B2 * | 10/2013 | Burlage et al. | 27/14 |
| 2003/0024089 | A1 * | 2/2003 | Dziekonski | 27/1 |
| 2009/0266108 | A1 * | 10/2009 | Balme et al. | 63/1.11 |
| 2010/0011549 | A1 * | 1/2010 | Thompson | 27/1 |
| 2010/0024480 | A1 * | 2/2010 | Emer | 63/1.14 |
| 2010/0299895 | A1 | 12/2010 | Burlage et al. | |
| 2012/0267383 | A1 * | 10/2012 | Van Rooyen | 220/694 |
| 2013/0074299 | A1 | 3/2013 | Rojdev | |

FOREIGN PATENT DOCUMENTS

| | | | |
|---|---|---|---|
| CN | 202146414 | | 2/2012 |
| CN | 202191444 | | 4/2012 |
| DE | 19608261 | A1 * | 8/1996 |
| JP | 3145162 | | 10/2008 |

OTHER PUBLICATIONS

Search Report, corresponding GB Application No. GB1314522.2, Jan. 30, 2014.

* cited by examiner

CREMATION URN WITH DECORATIVE APPLIQUE APPLIED THERETO

RELATED APPLICATIONS

This application claims the priority benefit of U.S. Provisional Patent Application No. 61/683,525 filed Aug. 15, 2012, which is hereby incorporated by reference herein as if fully set forth in its entirety.

FIELD OF THE INVENTION

This invention relates generally to cremation remains containers, and more particularly to cremation urns including memorialization features as a part thereof.

BACKGROUND OF THE INVENTION

Cremation is a growing segment of the funeral industry. Consequently, there is an increasing demand for more and higher quality styles and designs of cremation urns.

Likewise, memorialization is in ever greater demand in the funeral industry. As families have sought more meaningful ceremonies in celebration of the lives of their deceased loved ones, the assignee of the present invention has responded with new and innovative funeral products.

One such innovative cremation remains container is disclosed in U.S. Pat. No. 6,735,831, assigned to the assignee of the present invention, and hereby incorporated by reference herein as if fully set forth in its entirety. This patent discloses a cremation remains container comprising a receptacle for receiving cremation remains, a memorial plaque movably mounted to the receptacle to and between display and storage positions, a cover including having a transparent pane, and a removable tray for receiving mementos of memorialization positioned in the container. The tray is accessible via the cover and the mementos are visible through the pane.

There is a continuing demand for new and innovative styles and designs of funeral products, including cremation urns, which include memorialization features therein to assist in the cathartic process of the grieving family members of the deceased loved one.

SUMMARY OF THE INVENTION

In one aspect, a cremation urn is provided. The cremation urn comprises a container that has a lower end and an upper end, and that is sized and configured to receive therein cremation remains of a deceased. An access cover is removably secured on the lower end of the container providing access to an interior of the container. A receptacle is located on the upper end of the container and has a bottom wall and an upstanding side wall extending peripherally around the bottom wall. An appliqué is secured in the receptacle.

The side wall can have a particular peripheral geometric shape and the appliqué can have a mating peripheral geometric shape and is closely received by the side wall. For example, the side wall can be circular and the appliqué can be matingly circular so as to be closely received by the side wall.

As one example, the appliqué can be a simulative gem stone. The simulative gem stone can be fabricated from colored faceted glass. As another example, the appliqué can also be a medallion, for example cast medallion, button medallion, or domed medallion.

Preferably the container has a circular cross-section that varies from the lower end to the upper end, with the cross-section at its largest having a diameter dimension that is significantly greater than a height dimension of the container. For example, the largest cross-sectional diameter can have a dimension that exceeds the height dimension by a factor of about 2, and can be located nearer to the lower end than to the upper end.

The container can be fabricated of brass with the receptacle being formed integrally with the container. Alternatively, the container can be fabricated of brass, and the receptacle can fabricated of brass separately from the container and fastened to the container.

In another aspect, another cremation urn is provided. This cremation urn comprises a container that has a lower end and an upper end, a circular cross-section that varies from the lower end to the upper end, and that is sized and configured to receive therein cremation remains of a deceased. An access cover is removably secured on the lower end of the container and provides access to an interior of the container. A circular receptacle is located on the upper end of the container and has a bottom wall and an upstanding side wall extending circumferentially around the bottom wall. A matingly circular simulative gem stone, fabricated from colored faceted glass, is secured in said receptacle.

In another aspect, a method of merchandising cremation urns is provided. The method comprises the steps of displaying a cremation urn or a facsimile of a cremation urn comprising a container having a lower end, an upper end, and being sized and configured to receive therein cremation remains of a deceased, an access cover removably secured on the lower end of the container providing access to an interior of the container, and a receptacle on the upper end of the container, the receptacle having a bottom wall and an upstanding side wall extending peripherally around the bottom wall, displaying a plurality of differently colored simulative gem stones or facsimiles of differently colored simulative gem stones from which a customer may select, and securing a selected one of the differently colored simulative gem stones in the receptacle.

In another aspect, a method of personalizing a cremation container is provided. The method comprises the steps of selecting a cremation urn comprising a container having a lower end, an upper end, and being sized and configured to receive therein cremation remains of a deceased, an access cover removably secured on the lower end of the container providing access to an interior of the container, and a receptacle on the upper end of the container, the receptacle having a bottom wall and an upstanding side wall extending peripherally around the bottom wall, selecting a colored simulative gem stone from a plurality of differently colored simulative gem stones, and directing that the selected colored simulative gem stone be secured in the receptacle.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
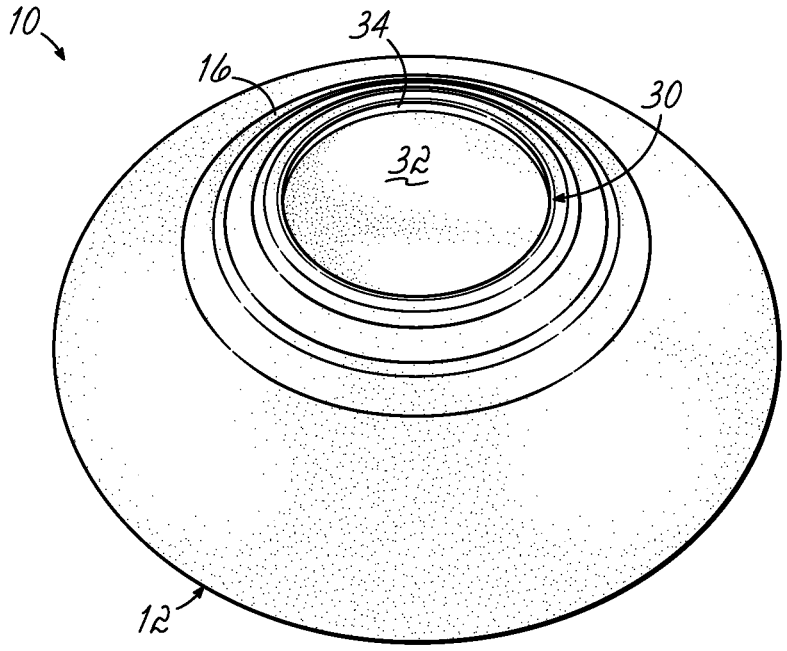
FIG. 1 is a top perspective view of a cremation urn of the present invention.
Figure 2:
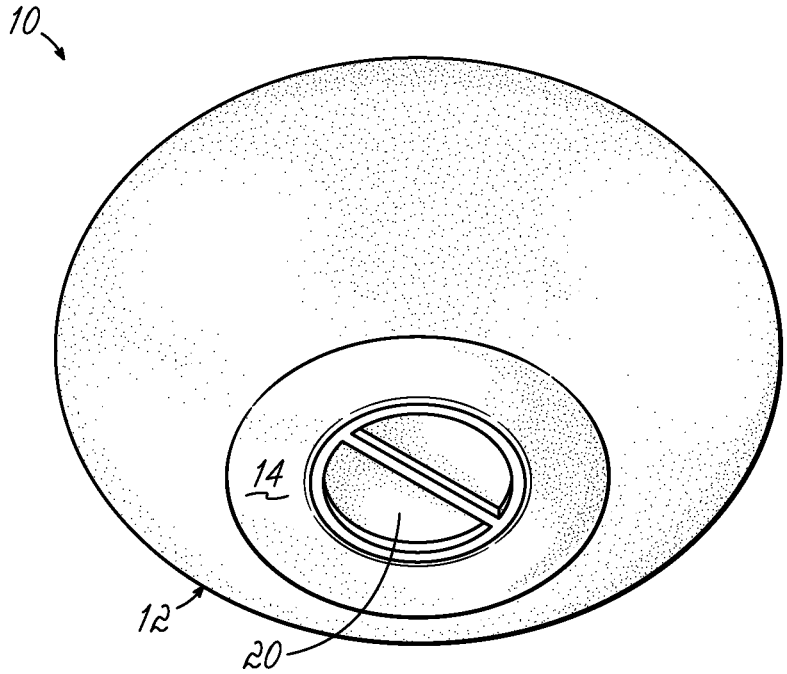
FIG. 2 is a bottom perspective view of the cremation urn of FIG. 1.

Referring to FIGS. 1, 2, 3A, and 3C, a cremation urn 10 according to the principles of the present invention is illustrated. The urn 10 has a container 12 that is sized and configured to receive the cremation remains of a deceased. The container 12 has a lower end 14 and an upper end 16. An access cover 20 is removably secured to the lower end 14 of the container 12 as by threads, screws, or the like and provides access to the interior of the container 12. A receptacle 30 is located on the upper end 16 of the container 12. The receptacle 30 has a bottom wall 32 and an upstanding side wall 34 extending around the periphery of the bottom wall 32. A decorative appliqué 40 is secured in the receptacle 30 as by double sided tape, or the like.

Figure 3A:
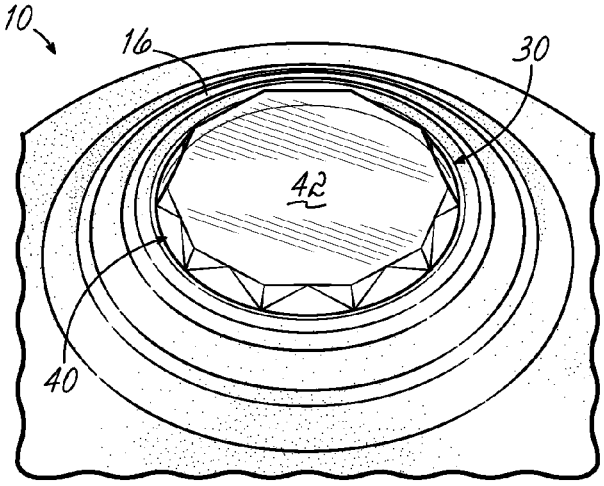
FIGS. 3A-3C are enlarged top perspective views of the upper end of the cremation urn of FIG. 1.

Referring to FIG. 3A, appliqué 40 can take the form of a simulative gem stone 42, as one example. Simulative gem stone 42 is preferably sized and shaped so as to closely fit within receptacle 30. In the exemplary embodiment illustrated, the side wall 34 is circular and the gem stone 42 is matingly circular. Other geometric shapes can of course be used. Simulative gem stone 42 could be fabricated of colored faceted glass. It is anticipated that a funeral director would have several colors of gem stones 42 on hand in stock for a customer to select from. Alternatively, the funeral director could display facsimiles of the available gem stones 42 to a customer via any convenient media, such as a product brochure, a web site, etc. If desired, the upper surface of gem stone 42 could be engraved with the deceased's name, date of birth, date of death, and the like.

Figure 3B:
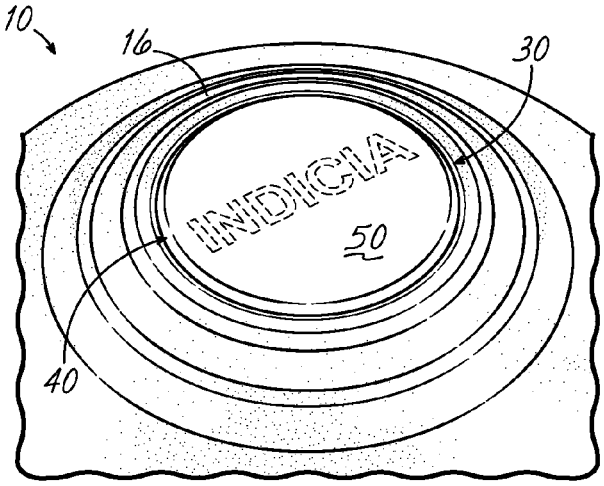

Referring to FIG. 3B, another example of appliqué 40 is a medallion 50. Medallion 50 can be of the cast medallion type disclosed in the assignee's US Patent Application Publication No. 2010/0299895 entitled Memorialization Casket And Method, or of the button medallion type disclosed in the assignee's U.S. patent application Ser. No. 13/242,594 filed Sep. 23, 2011 entitled Casket And Ornament Therefore, or of the domed medallion type disclosed in the assignee's U.S. Provisional Patent Application No. 61/675,628 filed Jul. 25, 2012 entitled Casket and Ornament Therefore, all of which are hereby incorporated by reference herein as if fully set forth in their entirety. Here again, it is anticipated that a funeral director would have several styles/designs of medallions 50 on hand in stock for a customer to select from, or the funeral director could display facsimiles of the available medallions 50 to a customer via any convenient media, such as a product brochure, a web site, etc., or a customer could simply make his/her own as taught in the assignee's U.S. patent application Ser. No. 13/242,594 and U.S. Provisional Patent Application No. 61/675,628.

Figure 3C:
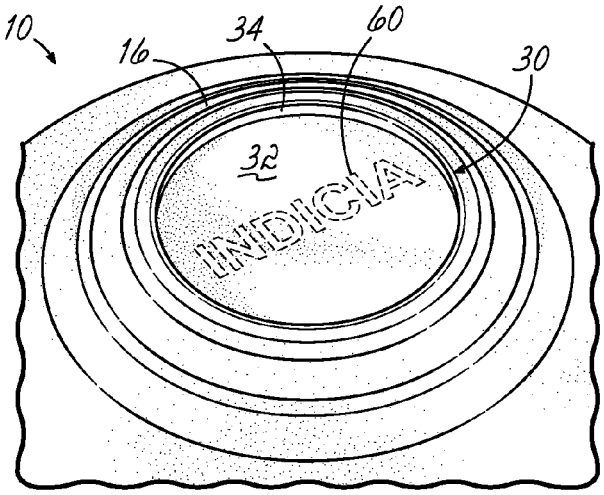

Referring to FIG. 3C, note that receptacle 30 could also be left empty, i.e. no appliqué 40 placed therein. In that case, the bottom wall 32 could be engraved as at 60 with the deceased's name, date of birth, date of death, and the like.

Note that the container 12 has a circular cross-section that varies from the lower end 14 to the upper end 16. At its largest, the diameter of the circular cross-section is significantly greater than the height of the container, for example about twice the height, and is located nearer to the lower end 14 than the upper end 16. This geometry aids in stabilizing the urn 12 and reduces the likelihood that it will be tipped over, as well as provides and aesthetic, ornamental look to the urn 10.

One example of a material from which to fabricate the urn 10 is brass. Note that the container 12 and receptacle 30 can be fabricated integrally, or the receptacle 30 can be fabricated separate from the container 12 and then attached to the container 12 after both are separately fabricated. The separate parts could be joined with the use of adhesives or the like. Fabricating the container 12 and receptacle 30 as separate parts lends itself well to creating a two-toned look for the urn 10.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. Accordingly, the scope of the invention shall be limited only by the following claims and their equivalents.

What is claimed is:

1. A cremation urn comprising:

a container having a lower end, an upper end, and being sized and configured to receive therein cremation remains of a deceased, an access cover removably secured on said lower end of said container providing access to an interior of said container, a receptacle on said upper end of said container, said receptacle having a non-recessed bottom wall and an upstanding side wall extending peripherally around said bottom wall, said upstanding side wall having a peripherally outer most surface positioned peripherally well within an extreme most perimeter of said container, and a solid, opaque appliqué having a thickness dimension thereof that is small in comparison to a transverse dimension thereof secured in said receptacle, wherein said container has a circular cross-section that varies from said lower end to said upper end, and wherein said cross-section, at its largest, occurs between said lower and upper ends, and has a diameter dimension that is significantly greater than a height dimension of said container, thereby stabilizing said urn and reducing a likelihood that said urn will be tipped over, wherein said upper end of said container is multi-tiered having a plurality of tiers decreasing in diameter from a lowermost one of said tiers to an uppermost one of said tiers, said upstanding side wall of said receptacle forming at least in part said uppermost one of said tiers.

2. The cremation urn of claim 1 wherein said side wall has a peripheral geometric shape and said appliqué has a mating peripheral geometric shape and is closely received by said side wall.

3. The cremation urn of claim 2 wherein said side wall is circular and said appliqué is matingly circular and is closely received by said side wall.

4. The cremation urn of claim 1 wherein said appliqué is a simulative gem stone.

5. The cremation urn of claim 4 wherein said simulative gem stone is fabricated from colored faceted glass.

6. The cremation urn of claim 1 wherein said appliqué is a medallion.

7. The cremation urn of claim 6 wherein said medallion is a button medallion.

8. The cremation urn of claim 6 wherein said medallion is a domed medallion.

9. The cremation urn of claim 1 wherein said largest cross-sectional diameter dimension exceeds said height dimension by a factor of about 2.

10. The cremation urn of claim 1 wherein said largest cross-sectional diameter dimension occurs nearer to said lower end than to said upper end.

11. The cremation urn of claim 1 wherein said container is fabricated of brass and wherein said receptacle is formed integrally with said container.

12. The cremation urn of claim 1 wherein said container is fabricated of brass, and wherein said receptacle is fabricated of brass as a separate component from said container and is fastened to said container.

13. The cremation urn of claim 1 wherein the diameter of said lowermost one of said tiers is less than the diameter of said container at said largest cross-section of said container.

14. A cremation urn comprising:

a container having a lower end, an upper end, a circular cross-section that varies from said lower end to said upper end, and being sized and configured to receive therein cremation remains of a deceased, an access cover removably secured on said lower end of said container providing access to an interior of said container, a circular receptacle on said upper end of said container, said receptacle having a non-recessed bottom wall and an upstanding side wall extending circumferentially around said bottom wall, said upstanding side wall having a peripherally outer most surface positioned peripherally well within an extreme most perimeter of said container, and a matingly circular solid, opaque simulative gem stone having a thickness dimension thereof that is small in comparison to a transverse dimension thereof, fabricated from colored faceted glass, wherein said cross-section of said container, at its largest, occurs between said lower and upper ends, and has a diameter dimension that is significantly greater than a height dimension of said container, thereby stabilizing said urn and reducing a likelihood that said urn will be tipped over, wherein said upper end of said container is multi-tiered having a plurality of tiers decreasing in diameter from a lowermost one of said tiers to an uppermost one of said tiers, said upstanding side wall of said receptacle forming at least in part said uppermost one of said tiers.

15. The cremation urn of claim 14 wherein said largest cross-sectional diameter dimension exceeds said height dimension by a factor of about 2.

16. The cremation urn of claim 14 wherein said largest cross-sectional diameter dimension occurs nearer to said lower end than to said upper end.

17. The cremation urn of claim 14 wherein said container is fabricated of brass and wherein said receptacle is formed integrally with said container.

18. The cremation urn of claim 14 wherein said container is fabricated of brass, and wherein said receptacle is fabricated of brass as a separate component from said container and is fastened to said container.

19. The cremation urn of claim 14 wherein the diameter of said lowermost one of said tiers is less than the diameter of said container at said largest cross-section of said container.

20. A method of merchandising a cremation urn comprising the steps of:

displaying at least one of the cremation urn and a facsimile thereof, the cremation urn comprising:

a container having a lower end, an upper end, and being sized and configured to receive therein cremation remains of a deceased, wherein the container has a circular cross-section that varies from the lower end to the upper end, and wherein the cross-section, at its largest, occurs between the lower and upper ends, and has a diameter dimension that is significantly greater than a height dimension of the container, thereby stabilizing the urn and reducing a likelihood that the urn will be tipped over, an access cover removably secured on the lower end of the container providing access to an interior of the container, and a receptacle on the upper end of the container, the receptacle having a non-recessed bottom wall and an upstanding side wall extending peripherally around the bottom wall, the upstanding side wall having a peripherally outer most surface positioned peripherally well within an extreme most perimeter of the container, wherein the upper end of the container is multi-tiered having a plurality of tiers decreasing in diameter from a lowermost one of the tiers to an uppermost one of the tiers, the upstanding side wall of the receptacle forming at least in part the uppermost one of the tiers, displaying a plurality of at least one of differently colored simulative gem stones and facsimiles of differently colored simulative gem stones, from which a customer may select, the gem stones being solid and opaque and having a thickness dimension thereof that is small in comparison to a transverse dimension thereof, and securing a selected one of the differently colored simulative gem stones in the receptacle.

21. The method of claim 20 wherein the diameter of the lowermost one of the tiers is less than the diameter of the container at the largest cross-section of the container.

22. A method of personalizing a cremation urn for a deceased comprising the steps of:

selecting the cremation urn comprising:

a container having a lower end, an upper end, and being sized and configured to receive therein cremation remains of a deceased, wherein the container has a circular cross-section that varies from the lower end to the upper end, and wherein the cross-section, at its largest, occurs between the lower and upper ends, and has a diameter dimension that is significantly greater than a height dimension of the container, thereby stabilizing the urn and reducing a likelihood that the urn will be tipped over, an access cover removably secured on the lower end of the container providing access to an interior of the container, and a receptacle on the upper end of the container, the receptacle having a non-recessed bottom wall and an upstanding side wall extending peripherally around the bottom wall, the upstanding side wall having a peripherally outer most surface positioned peripherally well within an extreme most perimeter of the container, wherein the upper end of the container is multi-tiered having a plurality of tiers decreasing in diameter from a lowermost one of the tiers to an uppermost one of the tiers, the upstanding side wall of the receptacle forming at least in part the uppermost one of the tiers, selecting a colored simulative gem stone from a plurality of differently colored simulative gem stones, the gem stones being solid and opaque and having a thickness dimension thereof that is small in comparison to a transverse dimension thereof, and directing that the selected colored simulative gem stone be secured in the receptacle.

23. The method of claim 22 wherein the diameter of the lowermost one of the tiers is less than the diameter of the container at the largest cross-section of the container.

* * * * *